US011583050B1

(12) United States Patent
Khodor

(10) Patent No.: US 11,583,050 B1
(45) Date of Patent: Feb. 21, 2023

(54) OFFSET HANDLE FOR TELESCOPIC FRAME

(71) Applicant: Leonid Khodor, Orange, OH (US)

(72) Inventor: Leonid Khodor, Orange, OH (US)

( * ) Notice: Subject to any disclaimer, the term of this patent is extended or adjusted under 35 U.S.C. 154(b) by 0 days.

(21) Appl. No.: 17/958,396

(22) Filed: Oct. 2, 2022

(51) Int. Cl.
*A45C 13/26* (2006.01)

(52) U.S. Cl.
CPC ..... *A45C 13/262* (2013.01); *A45C 2013/267* (2013.01)

(58) Field of Classification Search
CPC ..... A45C 13/262; A45C 2013/267
USPC ..... 190/115; 16/405, 110.1
See application file for complete search history.

(56) References Cited

U.S. PATENT DOCUMENTS

| | | | | |
|---|---|---|---|---|
| 3,513,952 | A | 5/1970 | Warner, Jr. | |
| 5,371,923 | A | 12/1994 | Chang | |
| 5,400,472 | A | 3/1995 | Chang | |
| 5,581,846 | A | 12/1996 | Wang | |
| 5,669,103 | A | 9/1997 | Hui | |
| 5,692,266 | A | 12/1997 | Tsai | |
| 5,694,663 | A | 12/1997 | Tsering | |
| 5,806,143 | A | 9/1998 | Tsai | |
| 5,984,327 | A | 11/1999 | Hsieh | |
| 6,081,967 | A | 7/2000 | Chang | |
| 6,141,828 | A | 11/2000 | Kuo | |
| 8,726,464 | B1 | 5/2014 | Tong | |
| 2003/0106755 | A1* | 6/2003 | Wang | A45C 13/262 16/113.1 |

* cited by examiner

*Primary Examiner* — John K Fristoe, Jr.
*Assistant Examiner* — Jessica Kavini Tamil

(57) ABSTRACT

Disclosed is an offset handle for telescopic frames provides for convenient and safe control of the telescopes, increased range of the frame extension, and improved portability when folded. The handle includes a hollow C-shaped housing configured for attaching to a pair of interlatching telescoping poles, an actuator configured to move in the housing laterally relative to the poles and biased to an initial position, a two pronged rocker having a crank, said two pronged rocker mounted pivotally within the housing and configured for engaging latching mechanisms of each of the poles, a ramp formed within the housing, and a pusher attached pivotally to said actuator. Said pusher configured to move between said ramp and said crank of said two pronged rocker.

7 Claims, 5 Drawing Sheets

OFFSET HANDLE FOR TELESCOPIC FRAME

FIELD OF THE INVENTION

The present invention generally relates to handling and operating of manually driven carriers, particularly, to telescopic frames of foldable carts and hand trucks.

BACKGROUND OF THE INVENTION

Various manually driven carrier vehicles, for example, hand trucks and carts are commonly used for moving objects that are otherwise inconvenient for a person to carry due to size and/or weight. Often, these hand trucks and carts are foldable and have telescoping frames for ease of storage and transportation when not in use. The frames of dedicated wheeled luggage carriers i.e. suitcases, crates, semi rigid bags, and the like, generally have straight handles at the top of the telescopes, for example U.S. Pat. Nos. 3,513,952, 5,692,266, 5,581,846, 5,694,663, 5,806,143, 6,081,967, and 8,726,464 due to their load not reaching the extended handle, which may comprise a control mechanism for latching the telescoping sections.

The general load carriers should be able to carry a load taller than their extended handles so, accordingly, the offset handles i.e. handles having their grips offset from a plane of telescopes are used to prevent possible interference of user's hand(s) with the load. Most common way to deal with this is to separate control mechanism of the telescopes from the handle, for example, as disclosed in U.S. Pat. Nos. 5,400,472 or 5,984,327, which makes the carrier taller in the folded state and shorter when extended, increases carrier's weight, and inconvenient to adjust height of the frame of the loaded carrier. Another approach is disclosed in U.S. Pat. No. 5,371,923 is deficient due to handle's offset constrained by a cam mechanism, obvious lack of frame's structural integrity, and possibility of a user involuntarily unlatching the frame at a wrong time.

Thus, conventional telescopic frames of carts and hand trucks, in addition to be able to provide for transport of predetermined load, are designed with tradeoffs between structural integrity of the carrier, convenient handling, and portability when folded. However, known solutions for the frames, independently of these tradeoffs, sacrifice to certain extent all the three mentioned parameters and add complexity and weight to the carriers.

Therefore, it is desirable to provide an offset handle for telescopic frames comprising a control mechanism for latching the telescope sections and free of the disclosed deficiencies.

SUMMARY OF THE INVENTION

The present invention particularly focuses on ways for increasing functionality of telescopic frames of foldable carts and hand trucks. Particularly, in its various embodiments and implementations, the invention provides for convenient and safe control of the telescopes, increased range of the frame extension, and improved portability when folded.

In general, an offset handle for telescopic frame includes a hollow C-shaped housing configured for attaching to a pair of interlatching telescoping poles, an actuator configured to move in the housing laterally relative to the poles and biased to an initial position, a two pronged rocker having a crank, said two pronged rocker mounted pivotally within the housing and configured for engaging latching mechanisms of each of the poles, a ramp formed within the housing, and a pusher attached pivotally to said actuator. Said pusher configured to move between said ramp and said crank of said two pronged rocker. Various embodiments and implementations of this aspect of the invention include the following features:

Said actuator may comprise more than one part. The housing may be split in, at least, two parts along the rocker's pivot axis with said parts together forming bearings for pivoting of the rocker. The pusher may further contain rollers for contacting separately said ramp and said crank. The housing may comprise fasteners arranged for fixing said each the poles to the housing and for ensuring said engagement of said latching mechanisms with said prongs. The ramp may have different gradient along its incline. The offset handle may further comprise additional side grips.

BRIEF DESCRIPTION OF DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
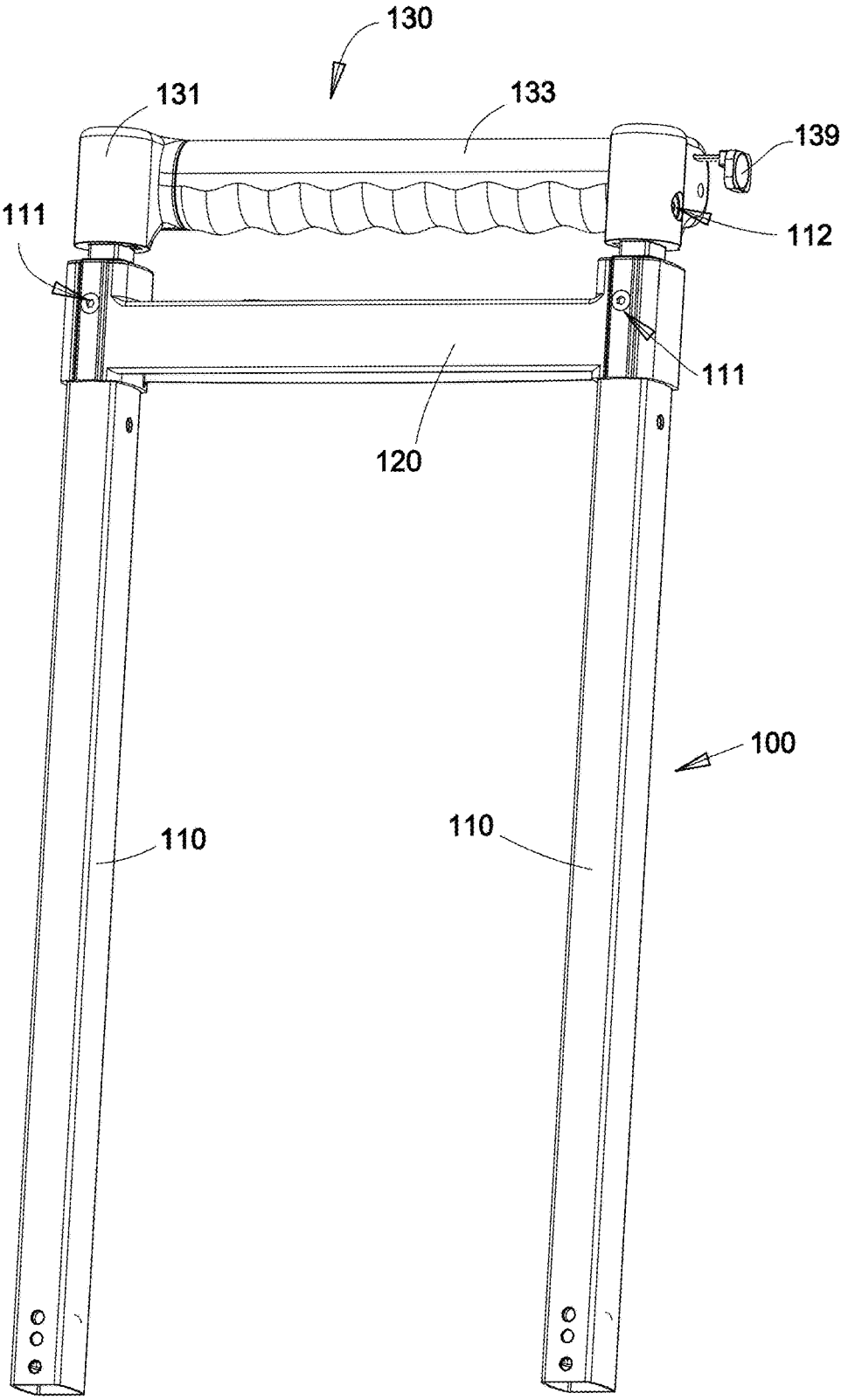
FIG. 1 depicts a perspective view of an embodiment of a telescopic frame in contracted state according to present invention.
Figure 2:
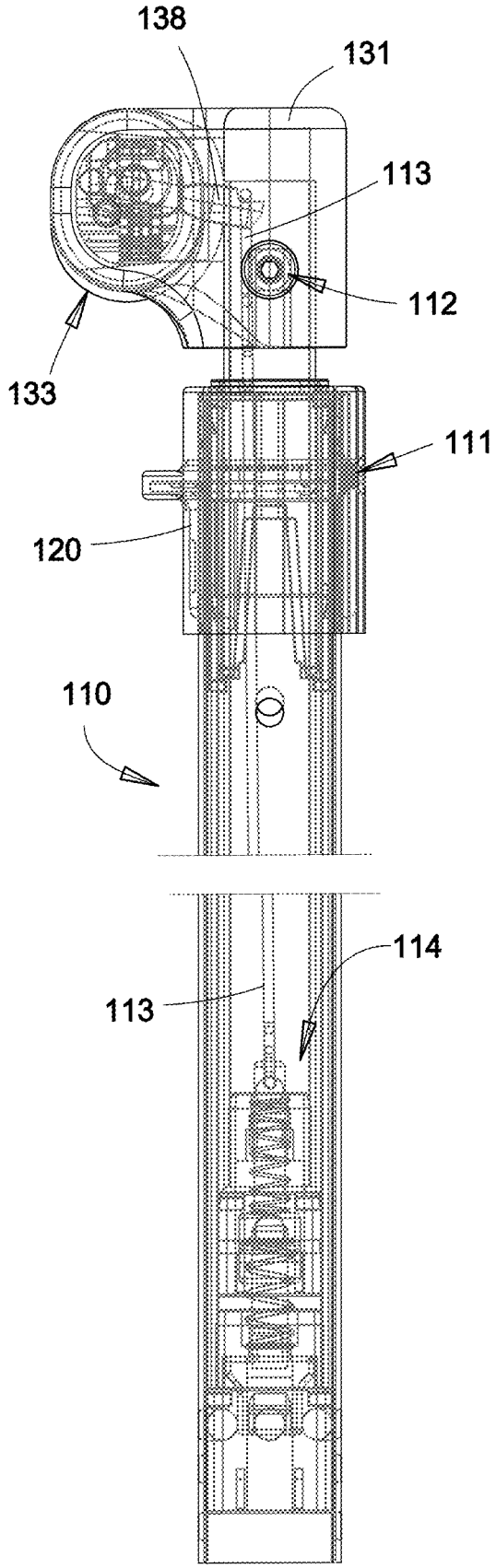
FIG. 2 depicts a view from the left of the embodiment shown in FIG. 1.
Figure 3A:
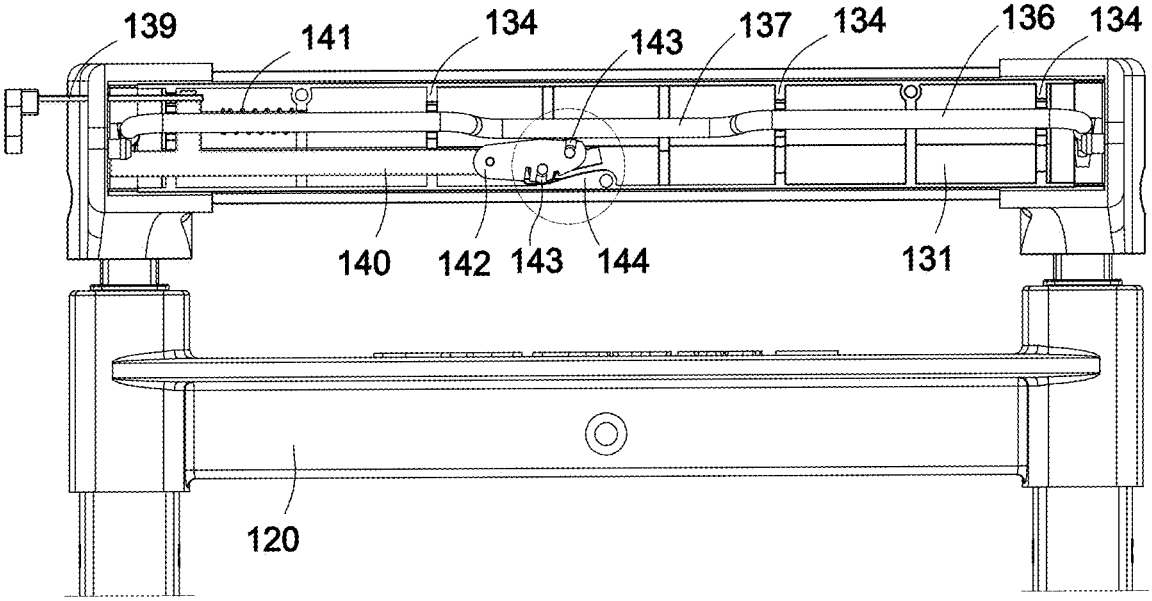
FIG. 3A depict a partial view from the back of an embodiment shown in FIG. 1 with parts inside the housing exposed.
Figure 3B:
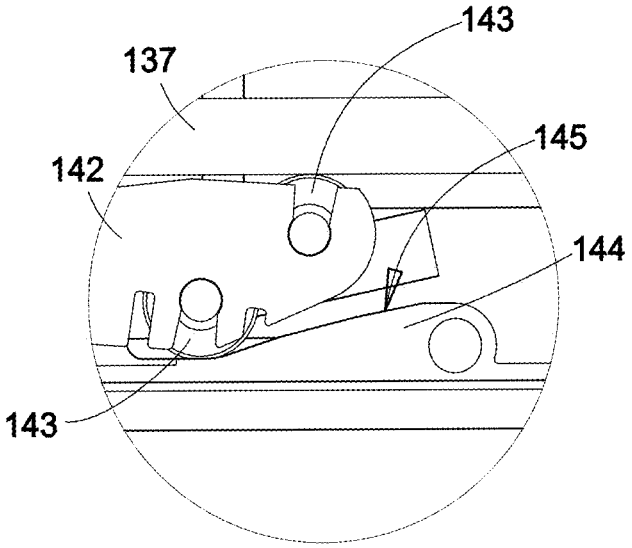
FIG. 3B depict a magnified partial view of elements from FIG. 3A.
Figure 4:
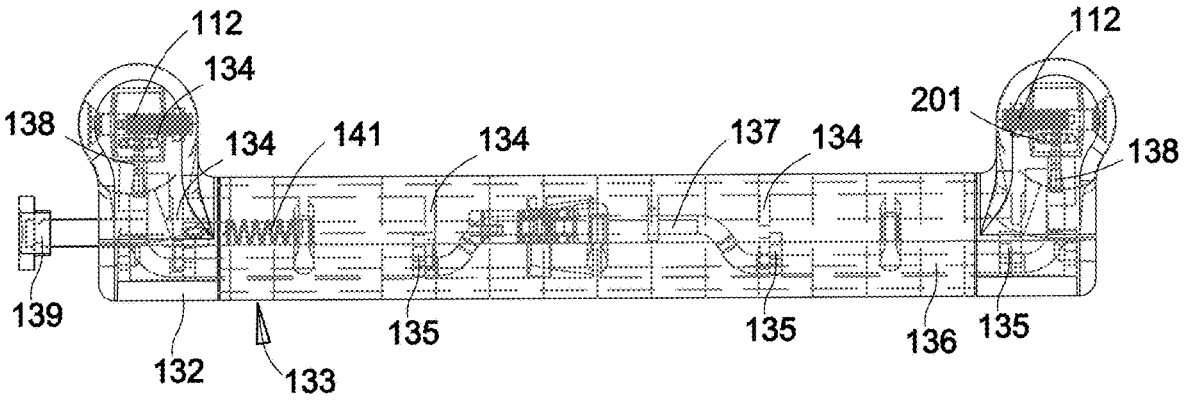
FIG. 4 depict top view of the handle of an embodiment shown in FIG. 1.

In the following detailed description, for purposes of explanation and not limitation, disclosing specific details is set forth in order to provide a thorough understanding of the present teachings. However, it will be apparent to one having ordinary skill in the art having had the benefit of the present disclosure that other embodiments according to the present teachings that depart from the specific details disclosed herein remain within the scope of the appended claims. Moreover, descriptions of well-known devices and methods may be omitted so as to not obscure the description of the embodiment. Such methods and devices are clearly within the scope of the present teachings. Set forth for better clarity in symmetrical structures, like reference characters may refer to like functioning mirrored parts as well as the same parts.

Referring to FIGS. 1-4, a generally symmetrical telescopic frame 100 may comprise telescopes 110 with a bridge 120 fastened by screws 111 and a handle 130 attached with elements 112, which may be removable i.e. screws or permanent i.e. rivets. Pulls 113 are connected to interlatching mechanisms 114 inside each of telescopes 110. Handle 130 may be formed by a housing 131 and a cover 132 held together by a cushion 133, which may be over-molded on. Ribs 134 and 135 of the housing 131 and the cover 132 respectively may have overlapping slots configured to create complete bearing surfaces for a rocker 136 having a crank 137 and prongs 138 configured for engaging the pulls 113, which prevented from disengagement by the elements 112.

Pushbutton 139 may connect with a slider 140 affected by a compression spring 141. Pusher 142 with rollers 143 may be pivotally attached to the slider 140 and configured to fit between a crank 137 of the rocker 136 and a ramp 144 of the housing 131, wherein one of the rollers 143 may contact only the ramp 144 and another one only the crank 137. A gradient of the ramp 144 may decrease along its inclined surface 145 for counteracting increasing forces on the pulls 113 from the interlatching mechanisms 114.

Pressing the pushbutton 139 causes the slider 140 to compress the spring 141 and roll the pusher 142 on one roller 143 along the surface 145 of the ramp 144 with another roller 143 moving lengthwise under the crank 137 and pivoting the rocker 136 up, which results in the prongs 138 unlatching of the interlatching mechanisms 114 by the pulls 113. Generally the pulls 113 may be in some intermediate position in addition to being determined by fully latched and fully disengaged the mechanisms 114 but the assembly of the pusher 142, slider 140, and pushbutton 139 is returned to its initial position by the spring 141 as soon at the pushbutton 139 released.

Figure 5:
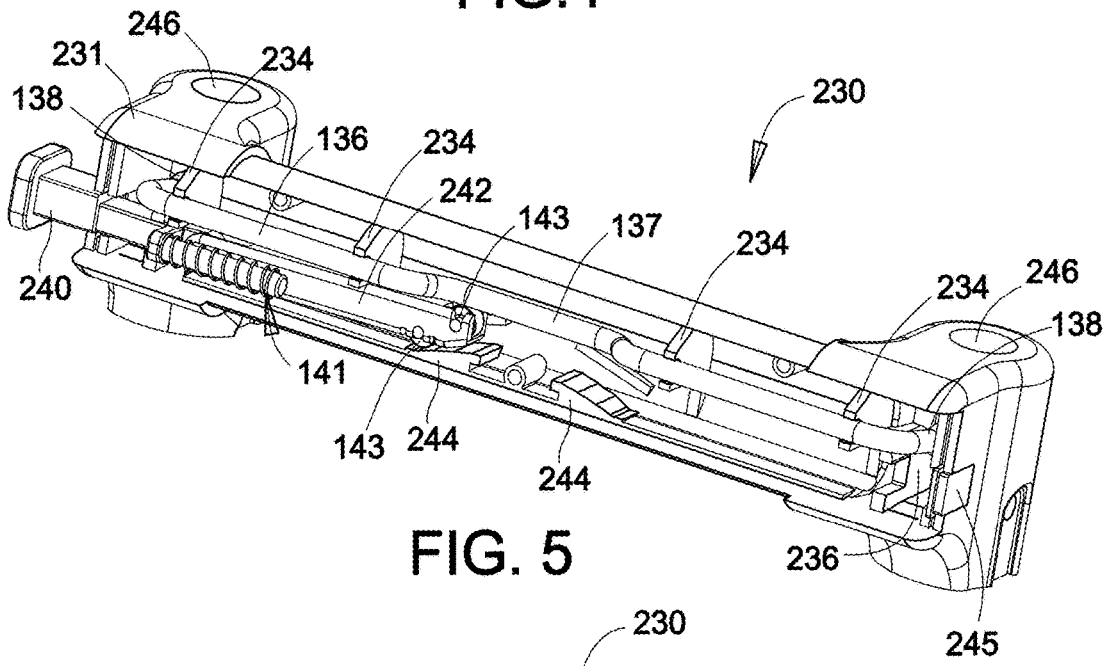
FIGS. 5, 6 depict respectively a perspective with parts inside the housing exposed and bottom views of another embodiment.
Figure 6:
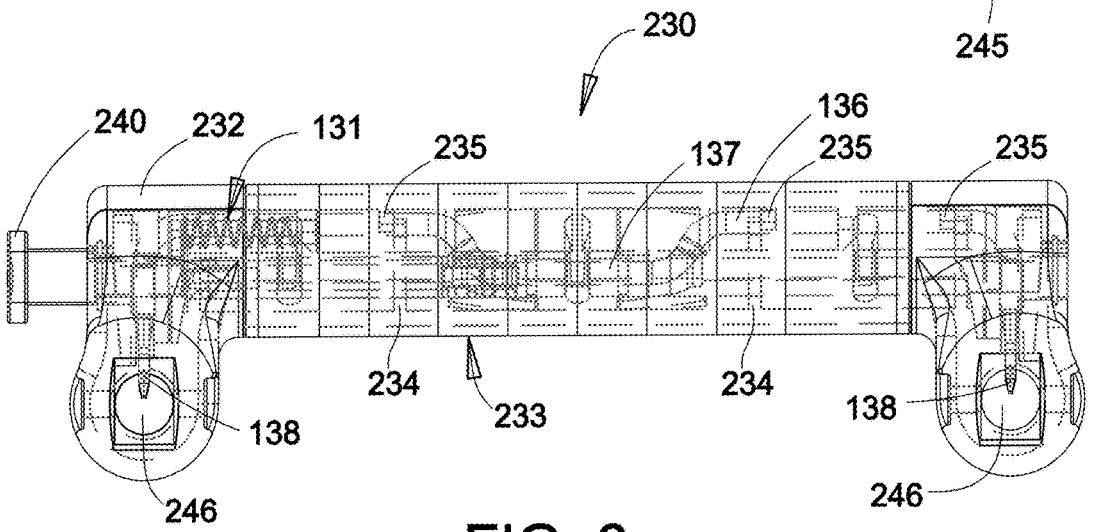

Referring to FIGS. 5 and 6, in another embodiment a handle 230 may be formed by a fully symmetrical housing 231 and a cover 232 held together by a cushion 233, which may be over-molded on. Ribs 234, 235, and 236 along with butt ends of the housing 231 and the cover 232 may have overlapping slots configured to create complete bearing surfaces for a slider 240 and the rocker 136. Slider 240 may be affected by the compression spring 141. Pusher 242 with the rollers 143 may be pivotally attached to the slider 240 and configured to fit between the crank 137 of the rocker 136 and one of the ramps 244 of the housing 231, wherein one of the rollers 143 may contact only the ramp 244 and another one only the crank 137. The handle 230 may be assembled in either left or right hand configuration, in each case the not used opening is closed by a plug 245. The housing 231 may have plugs 246 over openings made for an alternate assembly process.

Figure 7:
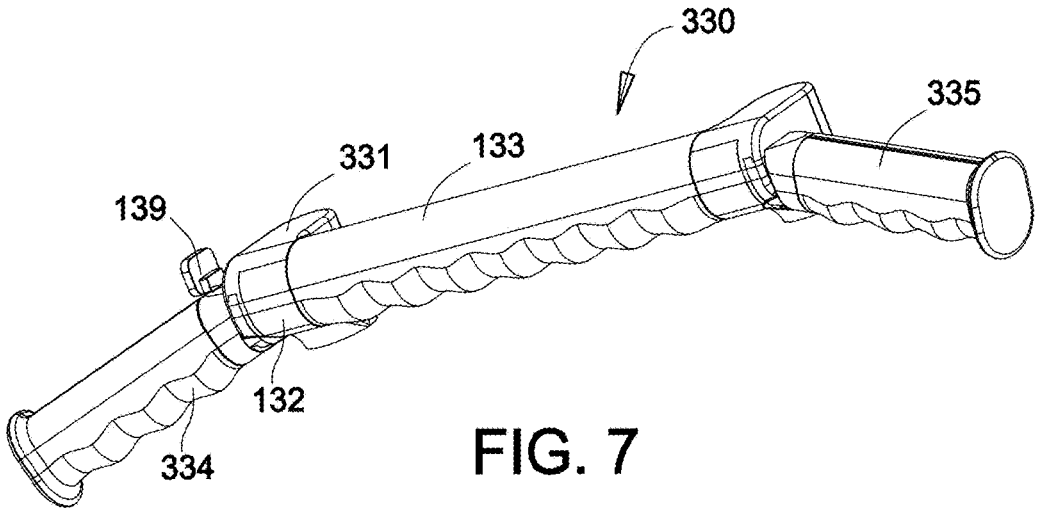
FIGS. 7-9 depict respectively a perspective, front with parts inside the housing exposed, and top views of yet another embodiment.
Figure 8:
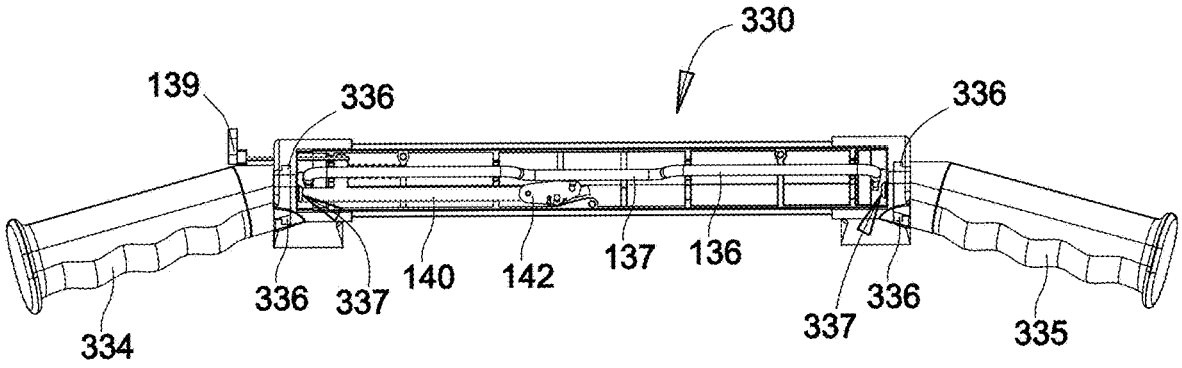
Figure 9:
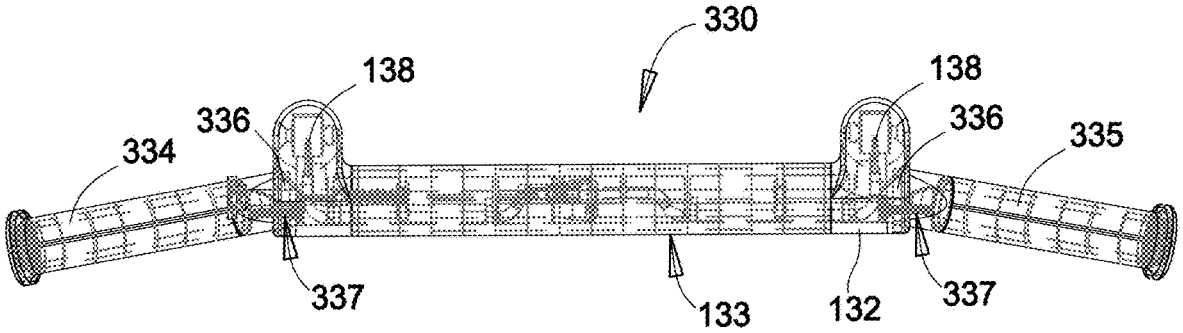

Referring to FIGS. 7-9, in yet another embodiment, a handle 330 differs in that respect that a housing 331 has side grips 334 and 335 attached to its ends. The grips 334 and 335 may have flanges 336 configured to fit closely within corresponding grooves at each end of the housing 331. Pushbutton 139 may be flipped to accommodate the grip 334. Screws 337 may be driven from inside of the housing 331 to fasten the grips 334 and 335 prior to placing the cover 132 and the cushion 133. Methods and means of fixing positions of one part relative to another well known in the art so, those of ordinary skill in the art will readily envision a variety of other means for attaching the grips 334 and 335 described above.

Consequently, the present invention in its various embodiments and implementations, provides for convenient and safe control of the telescopes, increased range of the frame extension, and improved portability when folded. Moreover, the invention facilitates greater self sufficiency for physically challenged persons by easy of use including controlling height of the handle contingent on a terrain.

While a specific inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. For example, entire mechanism of the handle may be inverted from pulling to pushing if latching mechanism of telescopes require that. It is possible as well to have the ramp on the crank instead of in the housing although it would be less effective solution due to lateral forces applied to the rocker. Those skilled in the art will recognize, or be able to ascertain using no more than routine experimentation, many equivalents to the specific inventive embodiment described herein. It is, therefore, to be understood that the foregoing is presented by way of example only and that, within the scope of the appended claims and equivalents thereto; inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms. The indefinite articles a and "an", as used herein in the specification and in the claims, unless clearly indicated to the contrary, should be understood to mean "at least one". As used herein, the terms "about" and "generally" refers to a +/−10% variation from the nominal value. It is to be understood that such a variation is always included in any given value provided herein, whether or not it is specifically referred to.

It should also be understood that, unless clearly indicated to the contrary, in any methods disclosed herein that include more than one step or act, the order of the steps or acts of the method is not necessarily limited to the order in which the steps or acts of the method are recited. In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

I claim:

1. An offset handle for telescopic frame comprising:

a hollow C-shaped housing configured for attaching to a pair of interlatching telescoping poles;

an actuator configured to move in said hollow C-shaped housing laterally relative to said interlatching telescoping poles and biased to an initial position;

a two pronged rocker having a crank, said two pronged rocker mounted pivotally within said hollow C-shaped housing and configured for engaging latching mechanisms of each of said interlatching telescoping poles;

a ramp formed within said hollow C-shaped housing; and a pusher attached pivotally to said actuator wherein said pusher configured to move between said ramp and said crank of said two pronged rocker.

2. The offset handle of claim 1, wherein said actuator comprise more than one part.

3. The offset handle of claim 1, wherein said hollow C-shaped housing is split in, at least, two parts along said two pronged rocker's pivot axis with said parts together forming bearings for pivoting of said two pronged rocker.

4. The offset handle of claim 1, wherein said pusher further comprising rollers for contacting separately said ramp and said crank.

5. The offset handle of claim 1, wherein said hollow C-shaped housing comprises fasteners arranged for fixing said each of interlatching telescoping poles to said hollow C-shaped housing and for ensuring said engagement of said latching mechanisms with said prongs.

6. The offset handle of claim 1, wherein said ramp have different gradient along its incline.

7. The offset handle of claim 1, further comprising additional side grips.

* * * * *